US005668332A

United States Patent [19]

Lombardi

[11] Patent Number: 5,668,332

[45] Date of Patent: Sep. 16, 1997

[54] CYMBAL POSITION CONTROL APPARATUS

[76] Inventor: Donald G. Lombardi, 2118 E. Hillcrest Dr., Thousand Oaks, Calif. 91360

[21] Appl. No.: 656,834

[22] Filed: Jun. 3, 1996

[51] Int. Cl.[6] ..... G10D 13/02

[52] U.S. Cl. ..... 84/422.3

[58] Field of Search ..... 84/422.3, 402; 248/345.1

[56] References Cited

U.S. PATENT DOCUMENTS

| | | | |
|---|---|---|---|
| 3,967,523 | 7/1976 | Currier et al. | 84/422 R |
| 4,365,535 | 12/1982 | Buttner et al. | 84/421 |
| 4,426,906 | 1/1984 | Otto | 84/402 |
| 4,458,574 | 7/1984 | Hoshino | 84/422 R |
| 4,520,710 | 6/1985 | Elliott, Jr. | 84/422 R |
| 4,747,333 | 5/1988 | Hoshino | 84/422 R |
| 4,889,028 | 12/1989 | Lombardi | 84/421 |
| 4,928,567 | 5/1990 | Kurosaki | 84/422.3 |
| 5,121,665 | 6/1992 | Myers et al. | 84/421 |
| 5,415,072 | 5/1995 | Huang | 84/422.3 |

*Primary Examiner*—Cassandra C. Spyrou
*Assistant Examiner*—Shih-Yung Hsieh
*Attorney, Agent, or Firm*—William W. Haefliger

[57] ABSTRACT

In a cymbals position control apparatus, the combination comprising a mechanism, including lever, a hook on the lever, and a handle on the lever to lift an upper cymbals disc, and to release the upper disc to drop toward a lower cymbals disc; means including a vertically movable upright rod to support the mechanism; and a bumper on the handle to bump against the rod before the hook can strike the rod, when the lever pivots to release the upper disc.

8 Claims, 6 Drawing Sheets

CYMBAL POSITION CONTROL APPARATUS

BACKGROUND OF THE INVENTION

This invention relates generally to construction and operation of cymbals apparatus, and more particularly to cymbals position control apparatus.

During playing of cymbals, it is at times desirable to release an upper cymbals disc to fall toward a lower cymbals disc, for playing of the discs positioned in adjacent relation. There is need for improved apparatus to achieve such upper disc release, and also to achieve upper disc retrieval in order to raise it above the lower disc.

SUMMARY OF THE INVENTION

It is a major object of the invention to provide improved means or apparatus meeting the above need. Basically, the improved cymbals position control apparatus comprises a) mechanism, including lever, a hook on the lever, and a handle on the lever to lift an upper cymbals disc, and to release the upper disc to drop toward a lower cymbals disc, b) means including a vertically movable upright rod to support said mechanism, and c) a bumper on the handle to bump against the rod before the hook can strike the rod, when the lever pivots to release the upper disc.

As will appear, the bumper may advantageously comprise an elastomeric body attached to the handle to operate as described, without production of a metallic "click" sound created by striking of the metallic lever against the rod.

It is another object to provide a support attached to the rod and pivotally supporting the lever, and a sleeve movable relative to and lengthwise of the rod, the sleeve carrying the upper cymbals.

Yet another object is to provide a positioner on the rod to position the upper disc when the rod and hook are lowered to retrieve the upper disc.

The method of use of such apparatus includes:

d) manually deflecting the lever to lower the bumper to thereby achieving release of the upper disc, to fall to a lower position adjacent the lower disc, the bumper thereafter sidewardly and soundlessly engaging the rod, e) lowering the rod and lever to achieve lever movement causing the hook to hook under an edge on structure associated with the upper disc, and f) allowing the rod and lever to rise to elevate the upper disc to a predetermined upper position.

These and other objects and advantages of the invention, as well as the details of an illustrative embodiment, will be more fully understood from the following specification and drawings, in which:

DRAWING DESCRIPTION

DETAILED DESCRIPTION

Figure 1:
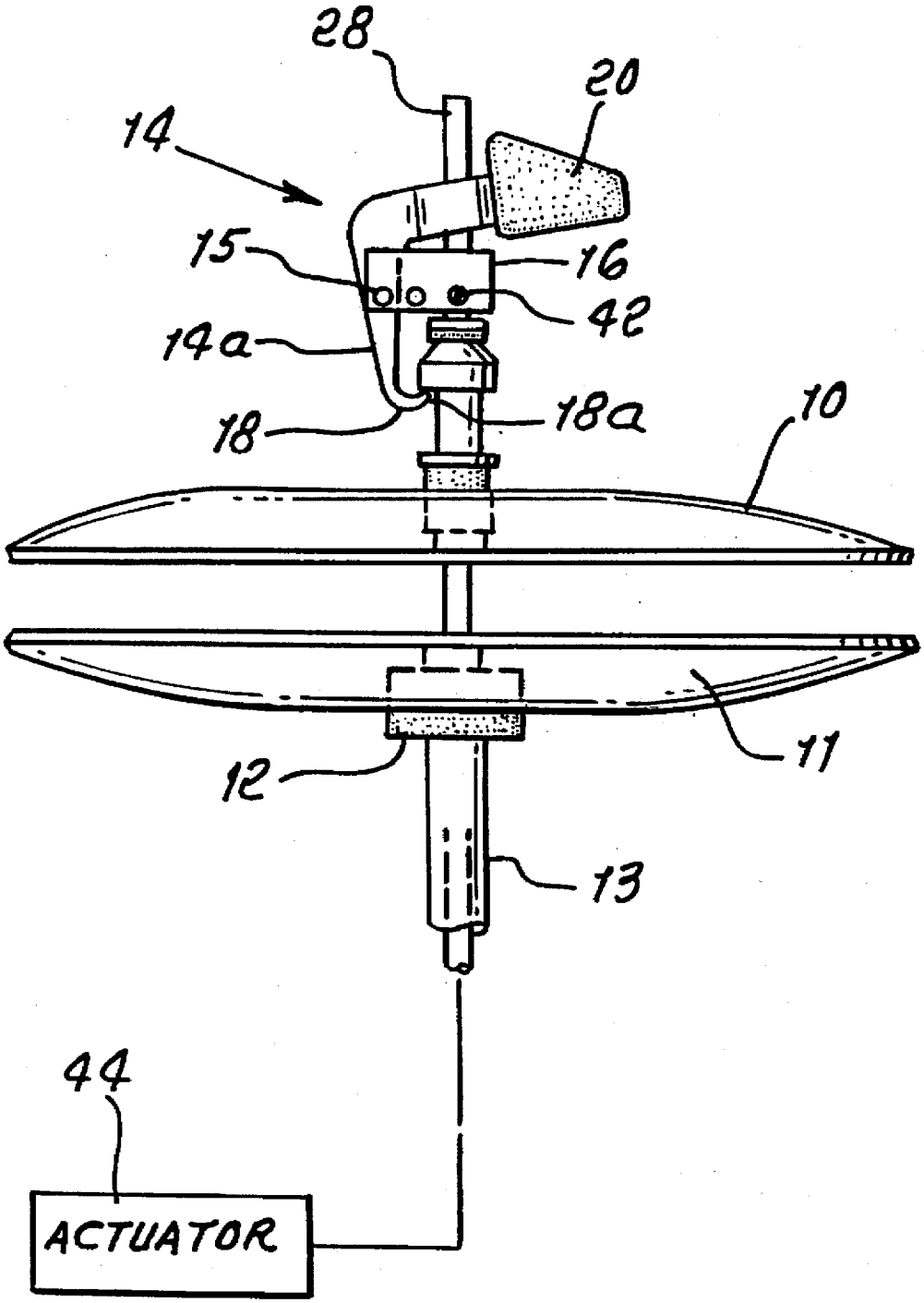
FIG. 1 is an elevation showing the apparatus with the upper cymbals discs elevated.

Referring first to FIG. 1 mechanism is provided to manipulate an upper cymbals disc 10 relative to a lower cymbals disc 11 which has fixed position, i.e. disc 11 does not move up or down. A support 12 for the lower disc is carried by a cymbals stand indicated at 13.

Figure 2:
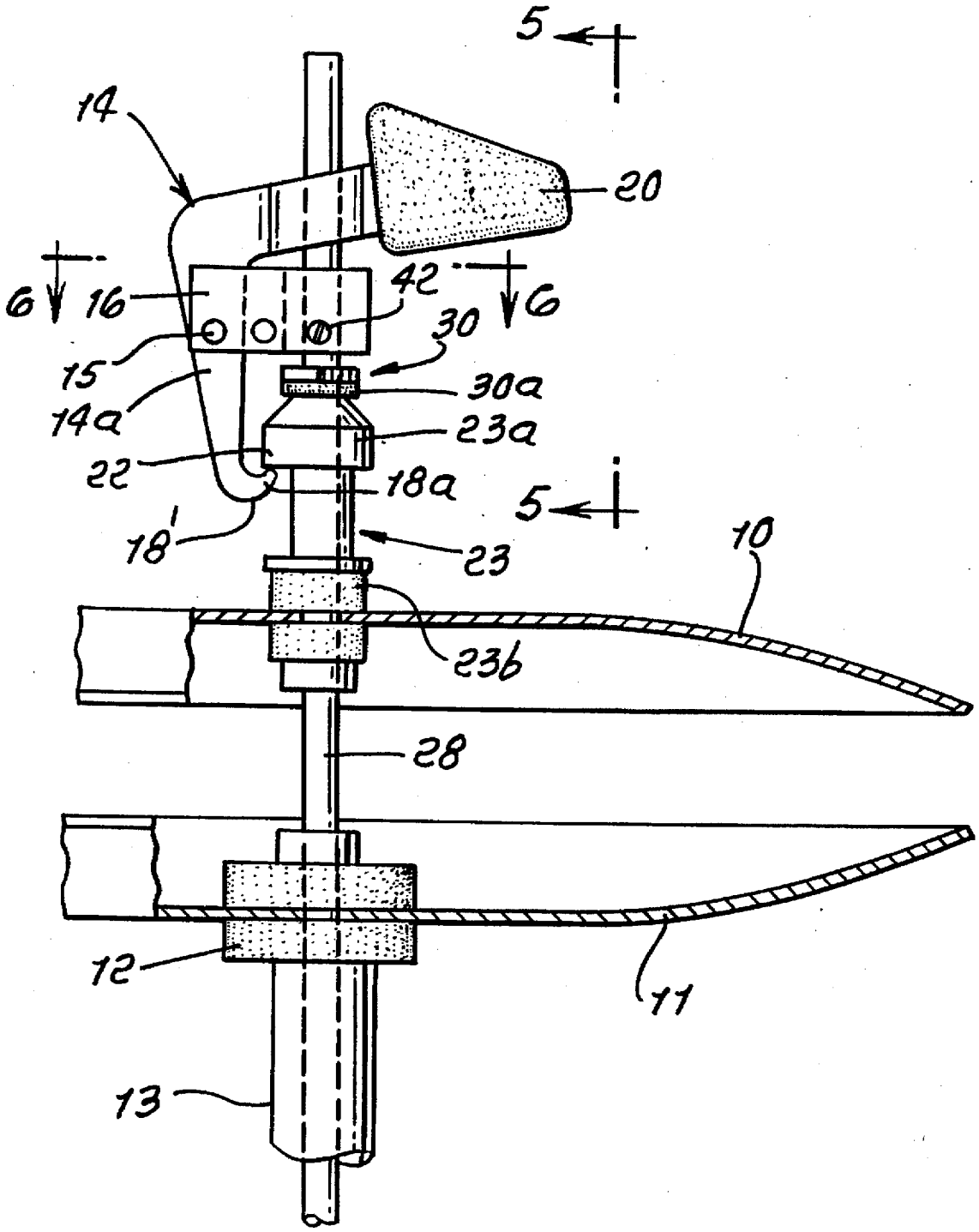
FIG. 2 is an enlarged view like FIG. 1.
Figure 3:
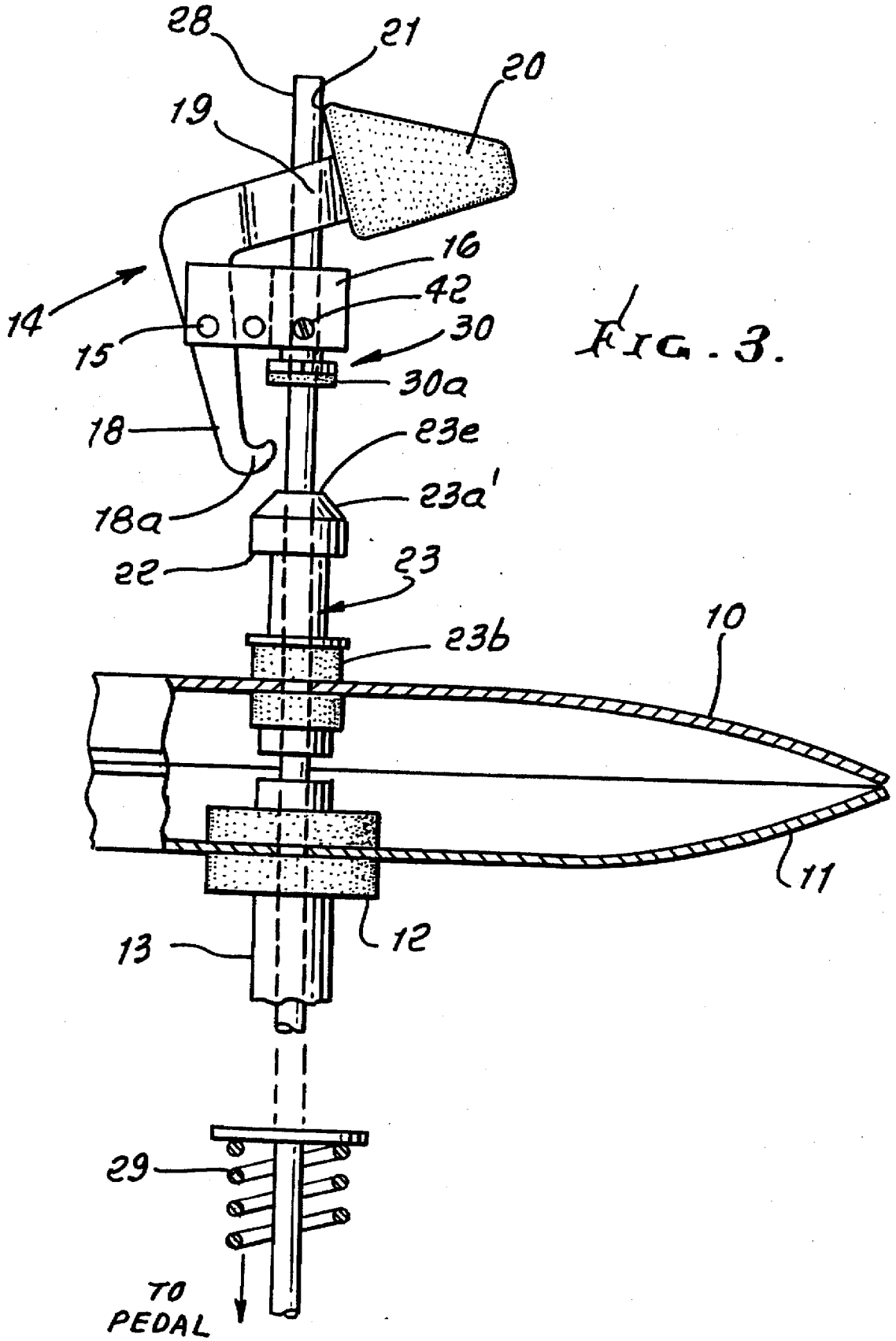
FIG. 3 is an elevation showing the upper cymbals disc at a lower or released position.
Figure 5:
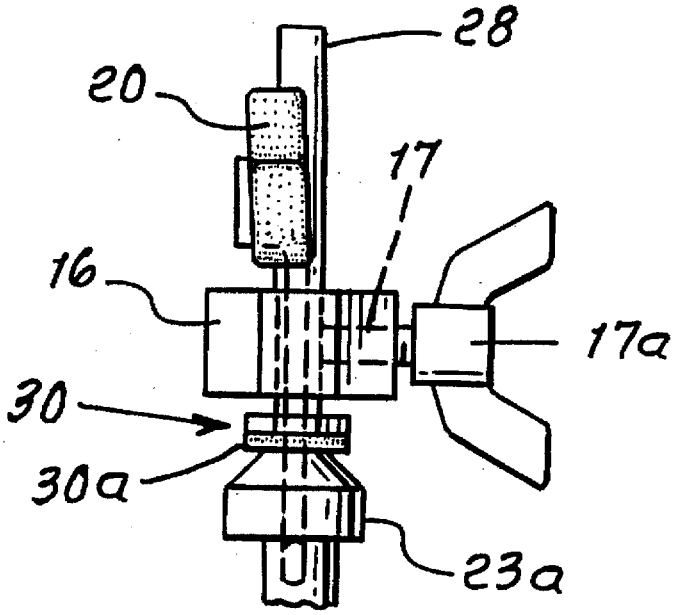
FIG. 5 is an elevation showing adjustable attachment of the lower support to the rod.
Figure 6:
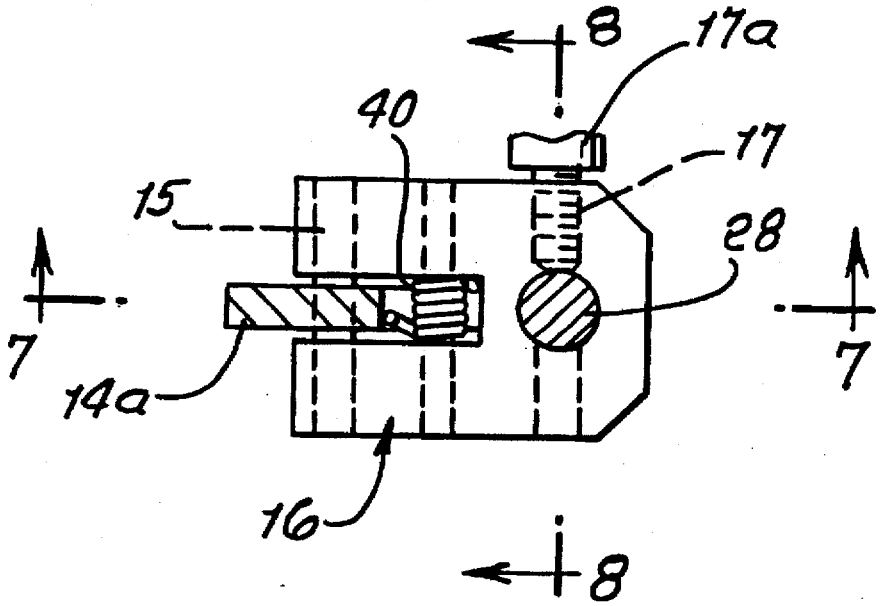
FIG. 6 is a section taken on lines 6—6 of FIG. 3.

The mechanism includes a lever 14 pivotally attached at 15 to a block 16. See also FIGS. 2 and 3. The block is attached at 17 to vertical rod 28, which is movable up and down to carry the block and the lever up and down. Part 17 is shown as a set screw carried by block 16 and rotated by a wing nut 17*a*, as seen in FIG. 5. Note that pivot 15 is sidewardly offset from the rod and connected to lever leg 14*a*. A hook 18 is provided on the lever and has a terminal 18*a* extending toward the rod. One object of the invention is to prevent audible click engagement of that terminal with the metal rod, during cymbals manipulation, as for example release, as shown in FIG. 3.

Figure 4:
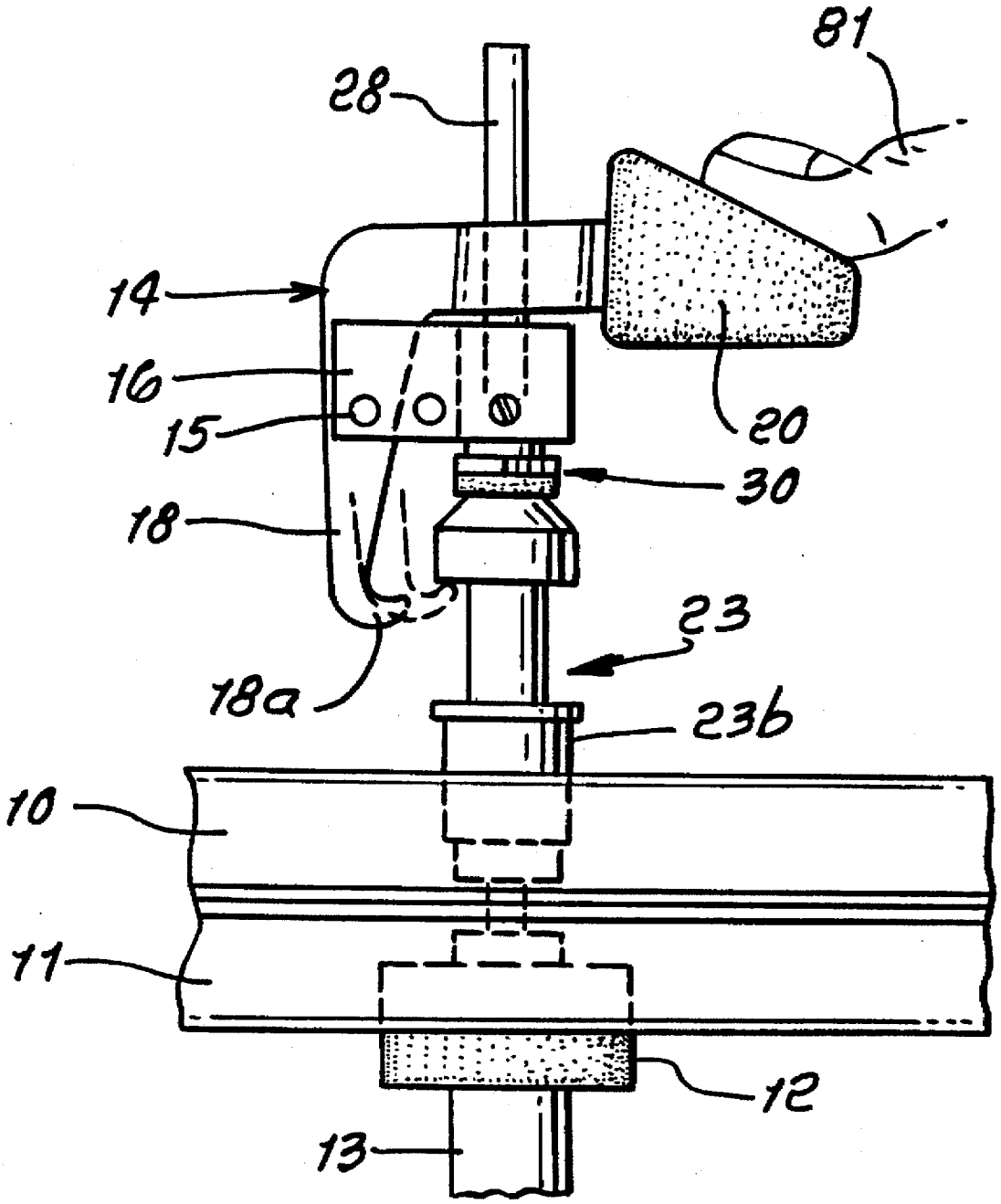
FIG. 4 is a view like FIG. 2, but showing upper cymbals release.
Figure 7:
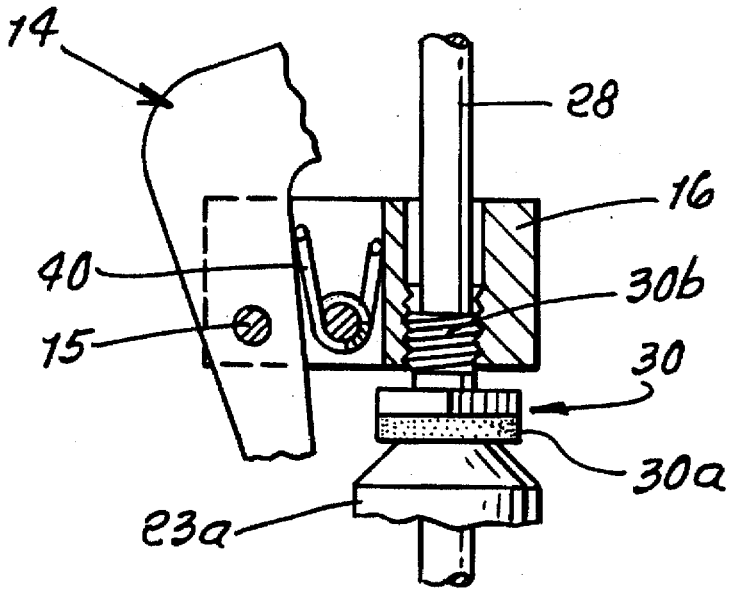
FIG. 7 is a section taken on lines 7—7 of FIG. 6.

A handle 19 is provided by the lever to extend back across the plane of the rod, and a bumper 20 is provided on the handle, and may be affixed thereto. The tip or edge 21 of the bumper facing the rod is engageable with the rod to provide a stop, limiting counterclockwise pivoting of the lever, thereby preventing tip 18*a* engagement with the rod, in FIG. 3. Spring 40 in FIG. 7 urges the lever counterclockwise. In this regard, the bumper, or at least its tip 21, may consist of rubber or other elastomeric material, or synthetic material, the objective being to prevent audible clicking engagement of that tip with the rod. The bumper is also large enough to be easily manually depressed, in a clockwise direction, as seen in FIG. 4. See user's finger 81.

Such clockwise movement causes the lever hook 18 to move free of a downward facing shoulder 22 on an enlargement 23*a* of sleeve 23. The sleeve carries the upper disc 10, as at 23*b* and is slidable up and down on the rod. Therefore, when the sleeve is released, the disc 10 is also released to drop with the sleeve. FIG. 3 shows the upper disc 10 in downwardly released position and peripherally extending adjacent the lower disc 11, whereby the drummer may play both discs, simultaneously.

To retrieve the upper disc 10, rod 28 is lowered as by drummer's foot pedal actuation, (see actuator 44 in FIG. 1) and thereby compressing spring 29 normally urging the rod upwardly. Such downward rod movement carries lever 14 downwardly, and this allows the hook 18 to cam outwardly on tapered surface 23*a*', and to fit under the shoulder 22 in the hook position indicated at 18' in FIG. 2. Thereafter, when the pedal is released, the spring 29 pushes the rod 28, the lever 14 and the upper disc 10 upwardly to FIG. 1 and 2 position.

Figure 8:
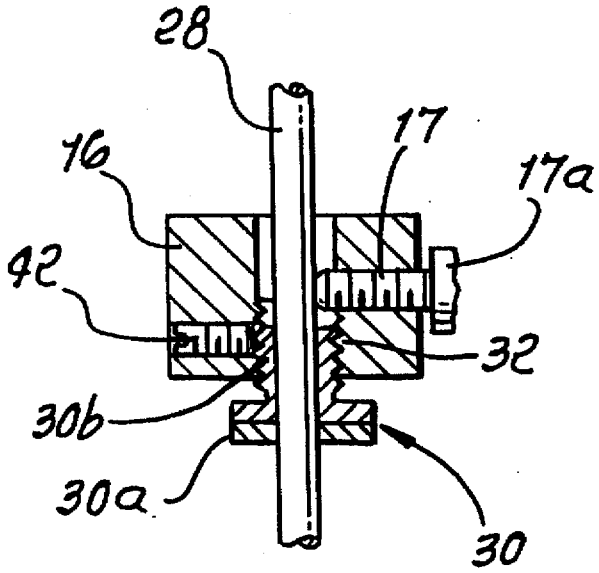
FIG. 8 is a section taken on lines 8—8 of FIG. 6.

A positioner 30 extending below the block 16, and about the rod, engages the upper surface 23*e* of the sleeve 23 to stably position the sleeve and the upper cymbals, axially, relative to the rod. That positioner may include a felt ring 30*a* that stably engages sleeve shoulder 23*e*. Positioner 30 is adjustably rotatable, and has a threaded stem 30*b* engaging threading 32 in block 16. See FIGS. 7 and 8. This axially adjusts the positioner. Rod 28 extends through 30*b*. A set screw 42 in 16 clamps stem 30*b* to lock 20 in position. See FIG. 8.

The method of use of the cymbals position control apparatus includes the steps manually deflecting the lever to achieve release of the upper disc, to fall to a lower position adjacent the lower disc, the lever being released to sidewardly and soundlessly engage the rod, lowering the rod and lever to achieve lever movement causing the hook to hook under an edge of structure associated with the upper disc, and allowing the rod and lever to rise to elevate the upper disc to a predetermined upper position.

I claim:

1. In a cymbals position control apparatus, the combination comprising a) mechanism including lever, a hook on the lever, and a handle on the lever to achieve release of the upper disc to drop toward a lower cymbals disc, b) means including a vertically movable upright rod to support said mechanism, and c) a bumper on the handle to bump against the rod before the hook can strike the rod, when the lever pivots following release of the upper disc.

2. The combination of claim 1 including a support attached to the rod and pivotally supporting the lever, and a sleeve movable relative to and lengthwise of the rod, the sleeve carrying the upper cymbals.

3. The combination of claim 2 including stop means carried below said support, to engage the sleeve when the rod and handle are lowered toward a position for hook engagement with the sleeve to lift the upper cymbals.

4. The combination of claim 3 wherein said hook projects toward the rod, at a location below said stop means.

5. The combination of claim 1 including adjustable means adjustably connecting said stop means to it.

6. The combination of claim 1 wherein said bumper comprises an elastomeric body carried by the handle to bump against the rod when the handle is manually deflected to release the upper disc.

7. In the method of use of a cymbals position control apparatus that comprises a) mechanism including lever, a hook on the lever, and a handle on the lever to rotate the lever to achieve hook release of the upper disc to drop toward a lower cymbals disc, b) means including a vertically movable upright rod to support said mechanism, and c) a bumper on the handle to bump against the rod before the hook can strike the rod, when the lever return pivots after release of the upper disc, said method including the steps:

d) manually deflecting the lever to achieve release of the upper disc, to fall to a lower position adjacent the lower disc, the lever rotatable to cause the bumper to soundlessly engage the rod, e) lowering the rod and lever to achieve lever movement causing the hook to hook under a edge on structure associated with the upper disc, and f) allowing the rod and lever to rise to elevate the upper disc to a predetermined upper position.

8. The method of claim 7 including providing a positioner on the rod to axially and stably position the upper disc when the rod and hook are lowered to retrieve the upper disc.

* * * * *